United States Patent [19]

Poppenheimer

[11] Patent Number: 4,674,187

[45] Date of Patent: Jun. 23, 1987

[54] POOL LIGHT INSTALLATION DEVICE

[75] Inventor: Charles B. Poppenheimer, Pasadena, Calif.

[73] Assignee: GTY Industries, Sylmar, Calif.

[21] Appl. No.: 821,394

[22] Filed: Jan. 22, 1986

[51] Int. Cl.[4] ..... B26F 1/14

[52] U.S. Cl. ..... 30/360; 83/631

[58] Field of Search ..... 83/55, 631, 689; 30/360, 361

[56] References Cited

U.S. PATENT DOCUMENTS

| | | | |
|---|---|---|---|
| 1,754,568 | 4/1930 | Nischan | 30/360 X |
| 1,817,223 | 8/1931 | Abramson et al. | 30/360 |
| 2,221,904 | 11/1940 | Abramson et al. | 30/360 |
| 2,735,489 | 2/1956 | Fowler | 30/360 |
| 3,056,203 | 10/1962 | Calkins | 30/360 |
| 3,670,610 | 6/1972 | Cady, Jr. | 83/689 X |
| 4,495,699 | 1/1985 | Oakes | 30/360 |
| 4,594,779 | 6/1986 | Hagemeyer | 30/360 |

FOREIGN PATENT DOCUMENTS

| | | | |
|---|---|---|---|
| 851760 | 1/1940 | France | 30/360 |

*Primary Examiner*—James M. Meister

*Attorney, Agent, or Firm*—Lyon & Lyon

[57] ABSTRACT

A pool light installation device is provided which quickly and easily cuts holes in the walls of above-ground pools. A cutting plate and a cutting base member are placed one on either side of the pool wall at the chosen location, joined together by a threaded bolt which passes through a small hole made previously in the pool wall. The threaded bolt is rotated by the use of a wrench or other tool causing the cutting plate to be drawn towards and into the cutting base member. The cutting plate has teeth formed therein which penetrate the pool wall and commence a shearing action between the cutting plate edge and the opening in the cutting base member, which then cuts a hole in the pool wall in the exact shape of the cutting plate.

2 Claims, 4 Drawing Figures

POOL LIGHT INSTALLATION DEVICE

BACKGROUND OF THE INVENTION

The field of the invention is that of pool light installation devices, although the invention may be readily adapted to other uses.

Above-ground pools are open topped tanks which have numerous advantages over pools which are installed in excavations in the ground and thus are quite popular. Such pools are frequently formed of a tough water-proof sheet-like material and provided with a frame to support this sheet-like material against the pressure of the water filling the pool. Swimmers and waders enter the pool by way of a ladder attached to the outside of the pool or a sun deck is built surrounding the edge of the pool from which access may be had to the pool; access to the sun deck is by way of stairs or ladder or perhaps from a nearby hillside.

The installation of underwater lights in such pools would be desirable in order to illuminate these pools at night, which would increase their usefulness and enjoyment. These lights may be installed in the above-ground pool by providing a hole in the side of the pool through which the light may shine from the outside into the interior of the pool, where a lens or a glass cover is provided to prevent water from entering the light and leaking out of the pool. A gasket is usually inserted between lens and pool wall to prevent water from leaking around the lens or glass plate covering of the light and thus out of the pool.

Accordingly, a need exists for a device which will easily, accurately, and cheaply cut holes of the appropriate outline (circular is usually preferred) in the material of the sides of above-ground pools. Preferably, the device should be capable of being used by the average homeowner so that home installation is possible.

SUMMARY OF THE INVENTION

The present invention is directed to a cutting and method for installing a pool light in an above ground pool. A cutting plate may be provided which is drawn into a hollow cutting base member by a tensioning member. According to the method, the cutting plate may be placed on one side of a pool wall and the hollow cutting base member on the other side; the tensioning member passes through a small hole in the wall previously made and draws the cutting plate through the wall and into the hollow cutting base member, thereby cutting a hole with the outline of the cutting plate cross-section.

An object, therefore, of the present invention is to provide apparatus for cutting accurate holes in thin walled material and a method for cutting holes in the walls of above-ground pools for installation of pool lights and other fixtures. How these and other advantages and features of the invention are met will become apparent in view of the detailed description of the preferred embodiment which follows.

DETAILED DESCRIPTION OF THE PREFERRED EMBODIMENT

Figure 1:
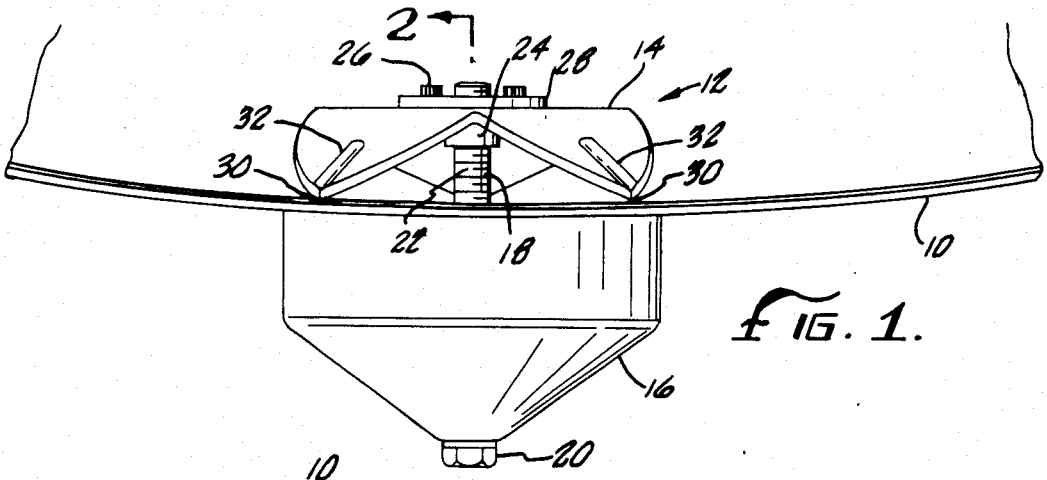
FIG. 1 is a top view of the preferred embodiment of the installation device of the invention located on the wall of an above-ground pool.

FIG. 1 in the drawings depicts a fragmentary portion of the wall 10 of an above-ground pool with the installation device 12 of the preferred embodiment of the invention located thereon. Cutting plate 14 is placed on the inside of the pool wall 10 and cutting base member 16 on the outside of the pool wall. Threaded bolt 18 serves as the tensioning member that draws the cutting plate 14 and the cutting base member 16 together, thus causing cutting plate 14 to cut through the pool wall. Bolt 18 has a hexagonal head 20 for engagement by a wrench or like instrument in order to rotate the bolt and thereby cause its threading 22 to advance through threaded sleeve 24, which in turn is attached to cutting plate 14 by way of fastening bolts 26 which pass through flange 28 (flange 28 being formed integrally with threaded sleeve 24) and cutting plate 14, and are held in position by nuts 28. Nuts 28 are not visible in FIG. 1 but may be seen in FIG. 2.

As may be observed in FIG. 1, cutting plate 14 has three cutting teeth 30 which are formed integrally in cutting plate 14 when cutting plate 14 is stamped out of sheet steel or the like. Grooves 32 strengthen the cutting teeth 30 and are also formed in the material of the cutting plate when that plate is stamped.

Figure 2:
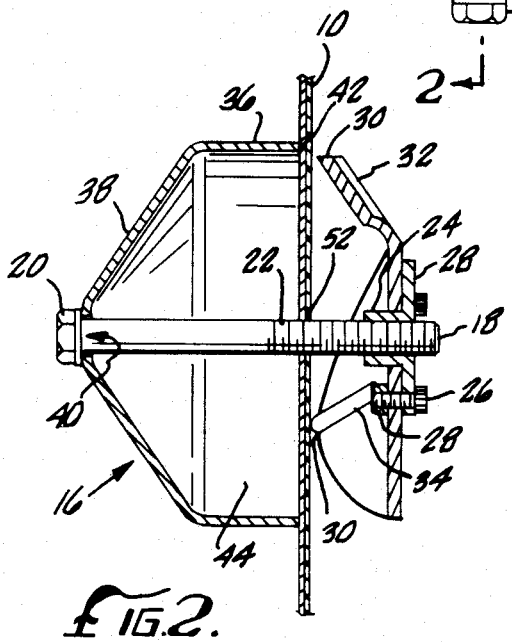
FIG. 2 is a cross section taken substantially on the lines 2—2 of FIG. 1 illustrating the installed installation device of the preferred embodiment of the invention.

FIG. 2 is a cross-sectional view of the installation device of the preferred embodiment of the invention mounted on the pool wall 10. This view is seen from the side, i.e., along a direction parallel to the ground if the device is mounted on a pool that has been installed. Two of the teeth 30 of cutting plate 14 may be seen as well as grooves 32 which strengthen the teeth. Grooves 32 form inner ridges 34, one of which may be seen in FIG. 2. Also seen is the threaded sleeve 24 with integral flange 28 and bolt 26 for attachment of the flanged threaded sleeve to the cutting plate.

When the threaded bolt 18 is rotated by a wrench applied at head 20, teeth 30 will be drawn into the pool wall 10 as cutting plate 14 is drawn closer to cutting base member 16. The teeth 30 will start the initial penetrations into the wall. On the other side of the pool wall is cutting base member 16 which, in the preferred embodiment, has a general cup-shaped appearance, being hollow with one side open. The walls of the cutting base member 16 form a cylindrical section 36 which merges into a conical section 38. At the apex of the conical section 38 is a hole 40 for a allowing insertion of the threaded bolt 18. The cylindrical portion of the cutting base member 16 is designed to be slightly wider than cutting plate 14 but not much so. Cutting plate 14 may therefore slide smoothly into cutting base member 16, producing a shearing action between the teeth 30 of the cutting plate 14 and the edge 42 of the opening 44 of the cutting base member 16. As teeth 30 penetrate further into wall 10 and onwards into the interior of the cutting base member 16 the generally circular edge 46 of the cutting plate will continue a shearing action, owing to the inclination of edge 46 with respect to edge 42 of cutting base member 16, until the cutting plate 14 has fully entered cutting base member 16, at which time wall 10 will have had a circular hole cut through it with neat and trim edges.

Figure 3:
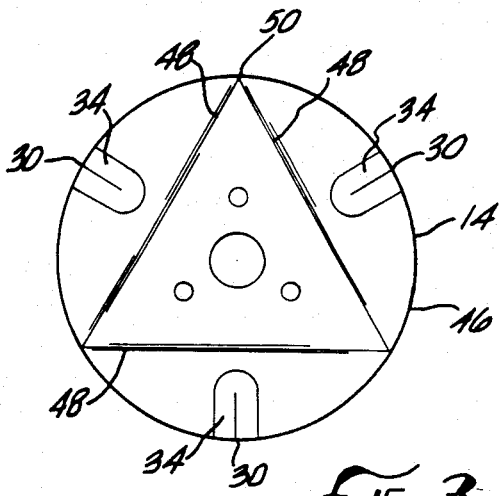
FIG. 3 is a plan view of the back of the cutting plate of the preferred embodiment of the invention.

FIG. 3 shows the underside of cutting plate 14 without the flanged threaded sleeve 24 installed or nuts 28. The ridges 34 caused by the indentations of grooves 32 may be seen in the vicinity of teeth 30. The teeth 30 are each formed by the combination of the folding down of a third of the outer edge 46 of the cutting plate along a line 48, together with the further indentation of groove 32. Because essentially all of the outer edge 31 of cutting plate 14 is folded down along the three lines 48, virtually all of the outer edge 46 will be inclined with respect to pool wall 10 and edge 42 of cutting base member 16 when the installation device is in position; this is essential for the shearing action that produces the cutting of the hole in the pool wall. One may note that lines 48 meet at intersections 50 to form an equilateral triangle; the portion of cutting plate 14 within the equilateral triangle is a flat sheet containing the holes for the flanged threaded sleeve 24 and fastening bots 26.

The principle of operation of the invention may be readily understood by an observation of FIGS. 1 and 2. First, the operator makes a small hole 52 wide enough for threaded bolt 18 in the pool wall 10 at the appropriate location. The operator may make this hole by using a screwdriver or an awl. The operator then places threaded bolt 18 in hole 40 at the apex of the conical portion 38 of cutting base member 16 so that the threaded portion 22 protrudes from opening 44 in the cutting base member. The operator inserts the threaded portion of bolt 18 through the hole 52 in wall 10; he or she then threads cutting plate 14 onto bolt 18 until teeth 30 engage the inner portion of wall 10. The operator applies a wrench or like instrument to head 20 of bolt 18 in order to cause it to rotate further. Teeth 30 dig into the inner portion of wall 10 and soon cut through and enter cylindrical portion 36 of cutting base member 16. As cutting plate 14 is drawn further into the cutting base member 16 the scissors-like action of the outer edge 46 of the cutting plate cooperating with the edge of the edge 42 of the cylindrical portion 36 of the cutting base member 16 cuts a circular hole in wall 10. Once the hole is cut the operator removes the entire installation device from the outside by pulling outwardly on the cutting base member 16. Unthreading bolt 18 from threaded sleeve 24 of the cutting plate disengages cutting plate 14 from cutting base member 16 in order to remove the cut-out portion of wall 10.

Figure 4:
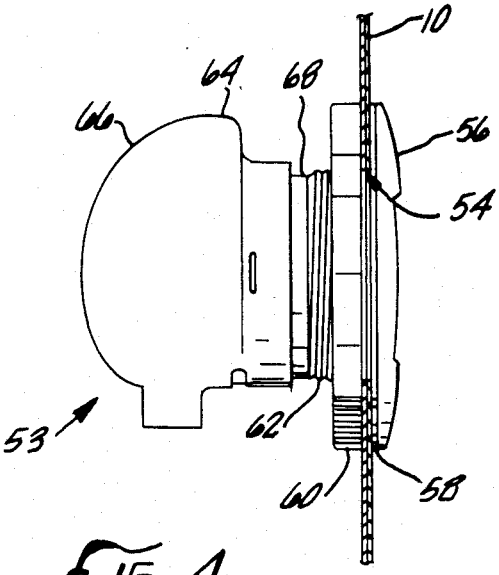
FIG. 4 is a side view of a pool light installed in the hole in the wall of the above-ground pool created by the installation device of the preferred embodiment of the invention.

FIG. 4 shows a pool light 53 installed in the hole 54 formed in pool wall 10. A pool light depicted in FIG. 4 has an inner portion 56 which includes such usual elements as a lens to permit light to pass through into the interior of the above-ground pool. Gasket 58 prevents the exit of water from the interior of the above-ground pool by sealing inner portion 56 against wall 10. A hex nut 60 acts in cooperation with threading 62 of the exterior portion 64 of the pool light, which external portion 64 is joined to inner portion 56, in order to hole inner portion 56 firmly against gasket 58 which is then pressed against wall 10. The exterior portion 64 of the pool light is actually composed of two elements: an illumination portion 66 containing the illumination means which may be a light bulb and reflector, and a further sleeve portion 68 which contains the threading 62, and which is formed integrally with inner portion 56. Sleeve portion 68 is attached to the portion 66 by virtue of being snapped on or by other attachment means.

Those skilled in the art will appreciate that many variations and modifications of the invention may be practiced which will not depart from the spirit and scope thereof. Having fully described the preferred embodiment of the invention, the invention is not limited to the details set forth therein but extends to the full scope of the appended claims.

What is claimed is:

1. An installation device, comprising a cutting plate having a plurality of cutting teeth formed therein, said teeth being formed in said cutting plate by folding down edges thereof, said teeth being further defined by forming grooves in said cutting plate;

a cutting base member defining a hollow concavity open on one side thereof for receiving said cutting plate, said cutting plate and said cutting base member having cross-sectional shapes which are substantially circular; and a tensioning member attachable to both said cutting plate and said cutting base member for drawing said cutting plate toward and into said concavity of said cutting base member, said cutting plate being capable of fitting sufficiently closely into said concavity of said cutting base member such that said cutting plate and said cutting base member are capable of cooperating so as to cut sheet-like material placed between them when drawn together, said grooves being open to a side of said cutting plate away from said cutting base member when said cutting plate and said cutting base member are operatively joined by said tensioning member.

2. The installation device according to claim 1 in which the tensioning member is a threaded bolt and a nut.

* * * * *